United States Patent [19]

Turner

[11] Patent Number: 4,790,250

[45] Date of Patent: Dec. 13, 1988

[54] DRY ASH HANDLING SYSTEM FOR AN INCINERATOR

[75] Inventor: Abner B. Turner, Hempfield Twp., Westmoreland County, Pa.

[73] Assignee: Westinghouse Electric Corp., Pittsburgh, Pa.

[21] Appl. No.: 157,085

[22] Filed: Feb. 5, 1988

Related U.S. Application Data

[63] Continuation of Ser. No. 9,847, Jan. 30, 1987, abandoned.

[51] Int. Cl.[4] ..... F23J 1/00

[52] U.S. Cl. ..... 110/165 A; 110/165 R; 414/373

[58] Field of Search ..... 110/165 R, 165 A, 169, 110/171; 414/373, 379

[56] References Cited

U.S. PATENT DOCUMENTS

| | | | |
|---|---|---|---|
| 1,703,814 | 2/1929 | Coutant | 110/165 R |
| 1,858,451 | 5/1932 | Coutant | 110/165 A |
| 1,940,663 | 12/1933 | Coutant | 110/165 A |
| 2,772,124 | 11/1956 | Smith | 414/373 |
| 2,789,715 | 4/1957 | Filipoff et al. | 414/373 |
| 3,057,309 | 10/1962 | Turner et al. . | |
| 3,357,576 | 12/1967 | Strombeck et al. | 414/373 |
| 3,690,392 | 9/1972 | Smith . | |
| 3,797,682 | 3/1974 | De Beer | 414/339 |
| 3,822,651 | 7/1974 | Harris et al. . | |
| 3,831,792 | 8/1974 | Waterman et al. | 414/373 |
| 4,057,978 | 11/1977 | Sato et al. | 110/165 R |
| 4,066,024 | 1/1978 | O'Connor . | |
| 4,226,584 | 10/1980 | Ishikawa . | |

FOREIGN PATENT DOCUMENTS

| | | |
|---|---|---|
| 481747 | 1/1917 | France . |
| 685920 | 7/1930 | France . |
| 521021 | 5/1940 | United Kingdom . |
| 520892 | 5/1940 | United Kingdom . |
| 663402 | 12/1951 | United Kingdom . |

*Primary Examiner*—Henry C. Yuen

[57] ABSTRACT

The invention is a dry ash handling system that allows ash to fall into a refractory lined ash car riding on rails in a sealed tunnel. The ash falls through a chute coupled to a negative pressure rotary combustor. Any unburned waste is allowed to continue burning in a burn-out chamber while, after removal from the chute because air is allowed to be pulled through the ash from the bottom by the negative pressure. When burn-out is complete, the ash is sprayed to quench any remaining smoldering embers. After removal from the tunnel, the car is sealed with a lid and allowed to cool further. During this period, samples can be removed from the car through sample ports. The car is transported to a landfill by a tilt bed truck and a hinged door on the car allows the ash to be dumped.

12 Claims, 8 Drawing Sheets

DRY ASH HANDLING SYSTEM FOR AN INCINERATOR

This application is a continuation of application Ser. No. 71/009,847, filed Jan. 30, 1987, abandoned.

BACKGROUND OF THE INVENTION

1. Field of the Invention

The present invention is directed to a dry ash handling system for a municipal waste incinerator that cools ash to room temperature for easy handling and, more particularly, to a system that collects ash in a car in a sealed tunnel, allows maximum burn-out of the waste to occur and water-spray cools the ash to a safe handling temperature while in the sealed tunnel before transporting the sealed car to a landfill.

2. Description of the Related Art

Municipal solid waste incineration systems such as illustrated in FIG. 1, burn waste dumped in chute 10 in a rotary combustor 12 such as an O'Connor combustor described in detail in U.S. Pat. Nos. 3,822,651 and 4,066,024. Part of the burned waste leaves the O'Connor combustor as fly ash which travels up a an after burner/gas cleaning chamber 14 and is collected in a fly ash collection system. Bottom ash, including partially burned embers, fall out of the combustor 12 into an ash burning and collection hopper 16 which includes a water cooled stairway grate 18 that allows large embers more time to complete burn-out as they roll down the stairway 18. The stairway 18 includes air injection ports which force air against the large embers and attempts to complete burn-out by holding the larger pieces in the chamber 14 for an additional time. The ashes then fall into a quenching tank 20 which includes a conveyor 22 which carries the wet ash to an ash car 24. The water serves two functions: (1) it quenches the sometimes still smoldering ash, and (2) it forms an air seal between the ash pit and the combustor 12 which operates at a slightly negative pressure. Incineration systems that include a conveyor 22 are frequently taken out of service because large objects get caught in the drag conveyor flights, breaking a drag chain, causing the conveyor 22 to grind to a halt. The system, in such a situation, will be out of service for at least eight hours, the time required to cool down and then reheat the combustor 12. The water from tank 12, before discharge back into the environment, must be treated. The full ash car 24, loaded with wet ash, is carried to a landfill and emptied. Since waste carriers charge by the pound for disposal, the wet ash is much more expensive to discard than would be the ash if it were dry.

Dry ash handling systems have been produced that replace the water tank 20 and stairway 18 with a slowly moving conveyor at the bottom of the combustor 12. The conveyor is located approximately four feet from the bottom edge of the combustor 12 and moves at a rate which allows approximately one foot of dry ash to be deposited on the conveyor. The conveyor is a grate type conveyor that allows air to be injected into the ash in an attempt to complete combustion of larger embers. However, considerable dusting and scattering of the ash occurs in such systems and at times, burn-out of the ash is incomplete, resulting in smoldering ash being carried to the landfill.

SUMMARY OF THE INVENTION

It is an object of the present invention to provide a dry ash handling system which protects operating personnel and the environment from exposure to combustor ash.

It is another object of the present invention to provide a dry ash handling system with a positive combustor seal.

It is also an object of the present invention to provide an ash handling system that allows maximum ash burn-out.

It is an additional object of the present invention to provide a system which will cool the ash to a safe handling temperature before transport to a landfill.

It is a further object of the present invention to provide a system which segregates batches of ash until analyzed and released for transport.

It is another object of the present invention to improve the operating time efficiency of rotary combustors.

The above objects can be attained by a dry ash handling system that allows ash to fall into a refractory lined ash car in a sealed tunnel. Any unburned waste is allowed to continue burning while in the car and until sprayed to quench any remaining smoldering embers and bring the moisture content up to an acceptable level. After removal from the sealed tunnel, the car is sealed with a lid and allowed to cool further before being sampled, tested and transported to a landfill by a tilt bed truck. At the landfill, a hinged door in the car allows the ash to be dumped.

These together with other objects and advantages which will be subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
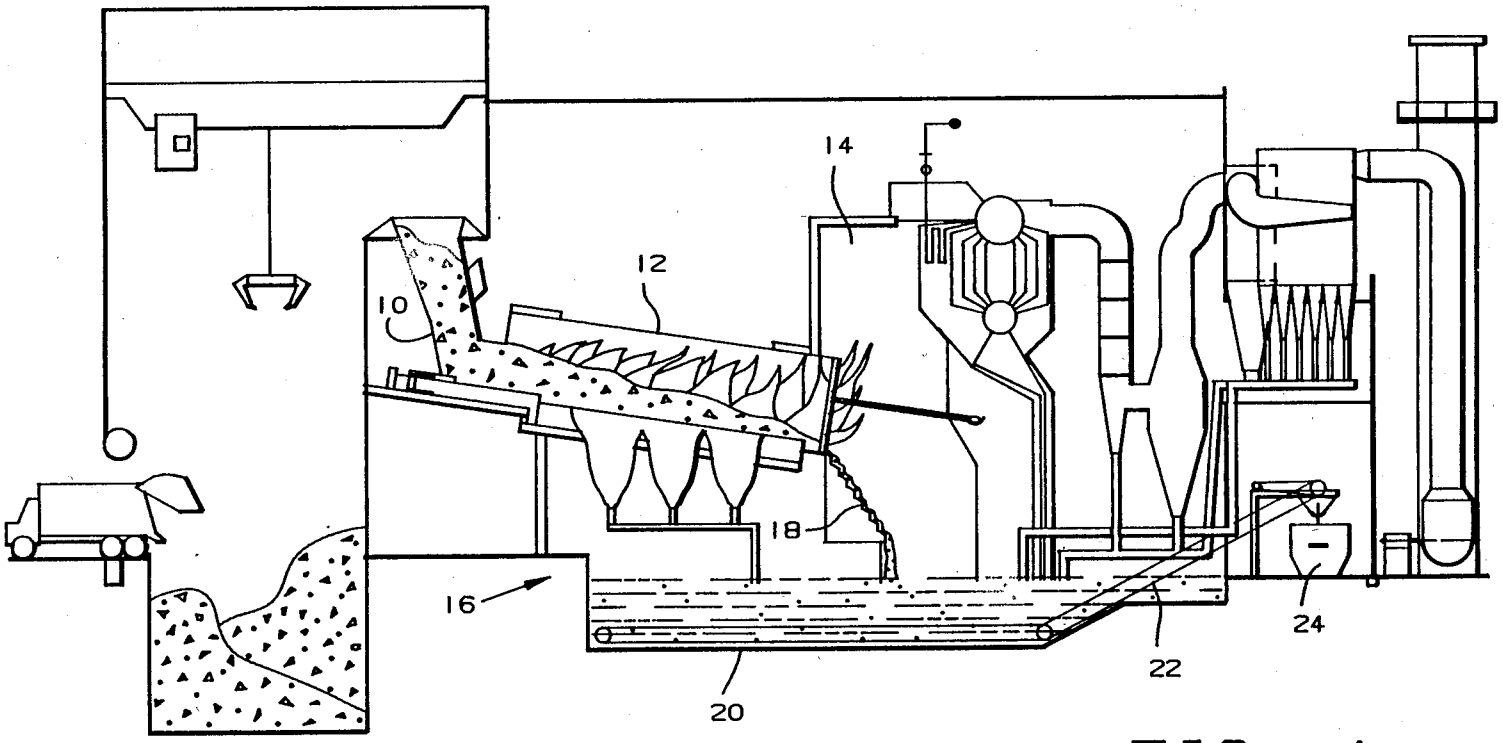
FIG. 1. PRIOR ART
FIG. 1 depicts a municipal waste incinerator with a prior art wet ash handling system.
Figure 2:
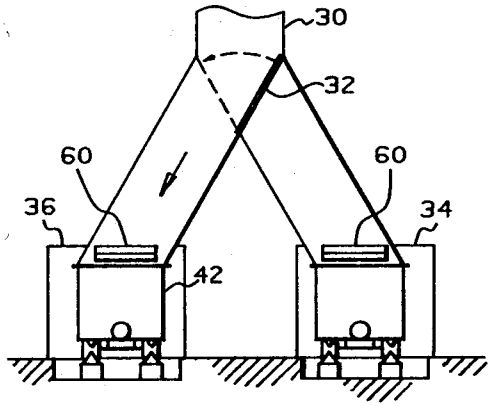
FIG. 2 is a cross-sectional view of a dry ash handling system according to the present invention.
Figure 3:
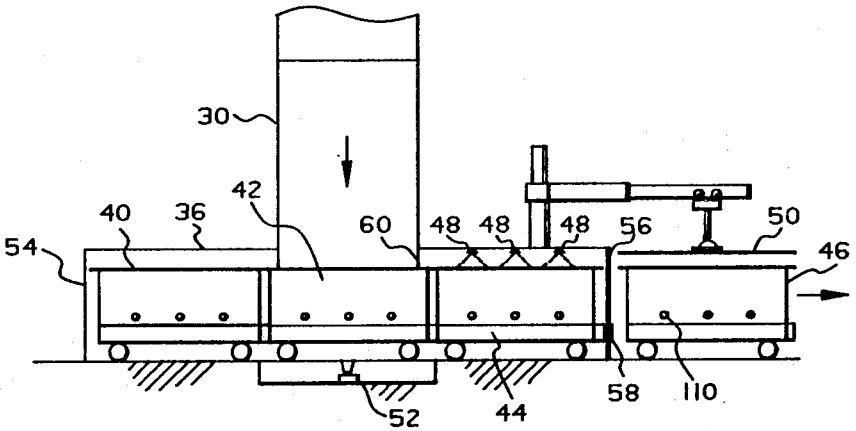
FIG. 3 is a side view of the system of FIG. 2.

Bottom ash falls from a combustor 22 through chute 30 and is diverted by a mechanically operated ash diverter gate 32 into one of two sealed ash tunnels 34 and 36, as illustrated in FIG. 2 where each tunnel is approximately 60 feet long, 10 feet high and 10 feet wide. Three ash cars 40–44 are positioned in each tunnel and one ash car 46 is outside each tunnel. Ash car 40 is waiting to be filled, car 42 is being filled with ash from the combustor 12 while car 44 is completing burn-out and being water-cooled by atomizer spray nozzles 48. Twenty three and one-half (23.5) gallons/minute of water for one hour is necessary to cool the ash from 1200° F. to 70° F. if no cooling outside the tunnel is allowed. Car 46 is being sealed with lid 50 before being transported to a landfill by a tilt bed truck.

If the car 42 is 8 feet by 8 feet by 20 feet it will hold approximately 25 tons of ash and can be filled in approximately 4 hours by a 100 inch diameter O'Connor combustor. When load cell 52 detect that car 42 is full, ash gate 32 pivots to allow ash to fall into tunnel 34, doors 54 and 56 on both ends of the tunnel are opened, allowing a tow motor type vehicle to push a car through the open door 54 at the same time shoving car 44 out door opening 56.

When the doors 54 and 56 are closed, air is allowed into the bottom of car 44 through louvers 58 in door 56. The air passes up through the ash and into the chute 30 through louvers 60 due to the −0.5 inches of pressure caused by combustor 12 in chute 30, allowing the ash in car 44 to continue to burn. Since it takes approximately 4 hours for a single car to be filled, with dual tunnels, the burn-out period can be approximately 7 hours, more than sufficient to allow combustion of unburned embers. The burn-out chamber can also include a chute for fly ash so that it can be commingled with the bottom ash.

Figure 4:
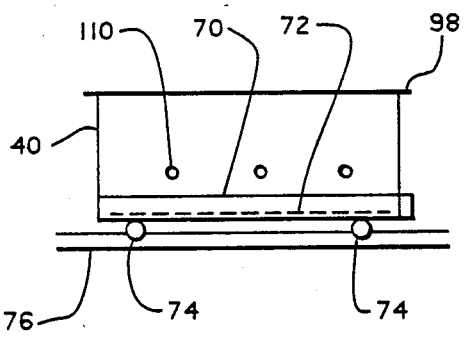
FIGS. 4 and 5 are side and end views of a car 40.
Figure 5:
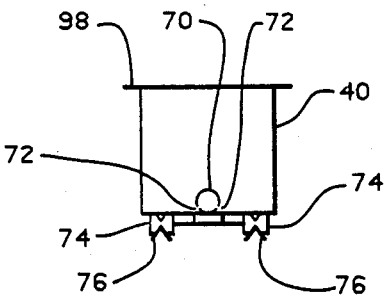

The air for continued combustion enters a steel pipe 70 which extends from the car 40, as illustrated in FIG. 4. The pipe is 6 inches in diameter and includes air holes 72 located near the bottom of the pipe at a 30° angle which allows air to infiltrate the ash without clogging the air holes 72. An air flow rate through holes 72 of approximately ten percent of combustion air is sufficient to maximize burn-out and the holes 72 should be sized accordingly. Additional pipes 70 or holes 72 can be added if faster burn-out is desired. It is also possible to provide sloped sides in car 40 which may improve burn-out speed.

Figure 6:
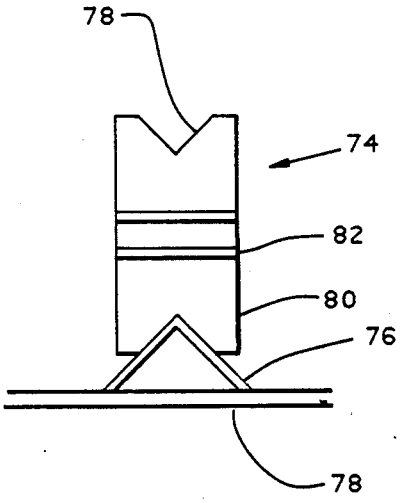
FIG. 6 is a detailed view of a car wheel 74 and tunnel track 76.

The cars 40–46 include notched wheels 74 that ride on 2-inch angle iron track 76 while in the tunnel 36. FIG. 6 illustrates the construction of a wheel 74 and track 76 in greater detail. The angle iron track 76 is welded to a deck plate 78 of the tunnel and carries a notched wheel 74. The notch 78 in the wheel 74 matches the shape of track 76. The flat surface of the wheel 74 allows the wheel 74 to roll on flat surfaces. The wheel 74 includes a carbon steel notched rolling surface 80 and a bronze press fit dry bearing 82.

Figure 7:
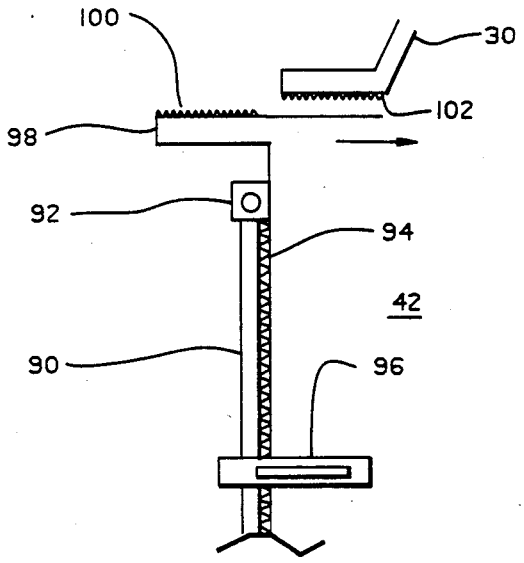
FIG. 7 illustrates sealing details of a car 42.

The rear of the car 42 includes a swinging door 90 such as a dump truck door, rotating about bar hinge 92, as illustrated in FIG. 7. The edge of the door 90 and lip of the car 40 include a fiber frax gasket 94 available from Carborundum, which is attached using a heat resistant ceramic adhesive such as Creamabond from Aremco. The gasket 94 prevents ash from migrating around the door 90. The door 90 is held shut by several over-the-center dump truck latches 96 which provide a tight fit between the door 90 and car 40. Each car 40 includes a top flange 98 which has a fiber frax gasket 100 attached to the top edge around the perimeter. The chute 30 also has a fiber frax gasket 102 which mates with the gasket 100 of each car 42 when the car 42 is positioned under the chute 30. The gaskets 100 and 102 when the car is in position prevent dust from billowing out of the car 42 as it is being filled.

Figure 8:
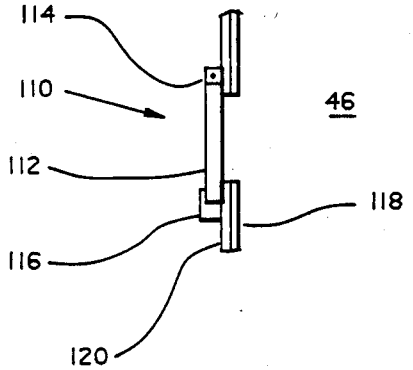
FIG. 8 depicts the details of a sample port 110.

After a filled car 46 has been moved outside the tunnel 36 and the lid 50 attached, the plant operator can obtain ash samples through porthole type sampling ports 110, illustrated in FIG. 8, spaced at periodic intervals on the side of the car. The sampling ports 110 include a cap 112 rotating on a bar hinge 114 and clamped in place by a latch 116. A sample thief identical to those used in grain storage elevators to sample grain from the interior of the elevator is inserted through the open sampling port 110 to obtain a sample for testing ash content to ensure that all the waste has been burned, including the complete combustion of hazardous chemicals. The interior wall 118 of the car 46 is lined with a cast refractory material such as Castolast-G available from Harbison-Walker, while the outer wall 120 is plate steel approximately ¼ inch thick. The refractory lining 118 is provided because ash is typically deposited in the car at approximately 1400° F.

Figure 9:
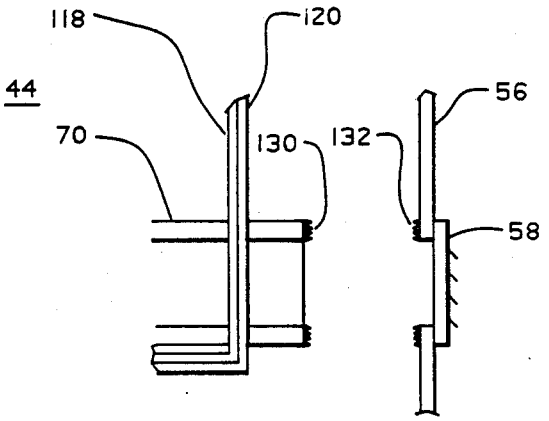
FIG. 9 shows an air infusion pipe 70 and exit door louvers 58.

The pipe 70 which extends through the end of the car opposite the hinged door 90 mates with door louver 58 using fiber frax gaskets 130 and 132, as illustrated in FIG. 9. The interior of the pipe is exposed to the openings in louver 58 which can be manually opened and closed to control airflow into the car 44. If mating between the louver 58 and pipe 70 becomes a problem because of inadequate movement by car 44 toward door 56, the louver 58 can be provided with a telescopic type extension.

Figure 10:
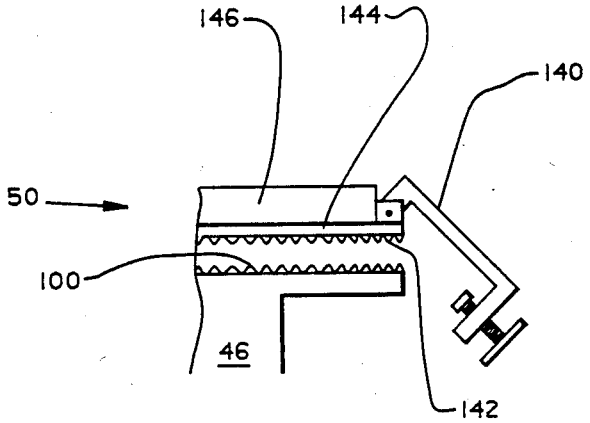
FIG. 10 illustrates a lid 50 being clamped to a car 46.

The lid 50, illustrated in detail in FIG. 10, seals the car 46 for transportation to a landfill and includes a C-clamp 140 which clamps the lid 50 to the car 46 compressing fiber frax seal 100 and 142 together. The fiber frax seal 142 is attached to the edge of the lid 50 which is constructed of a ⅛ inch steel plate 144 and a one inch sheet 146 of plywood glued to the plate 144. The plywood provides rigidity at low weight, while the steel provides heat resistance.

Figure 11:
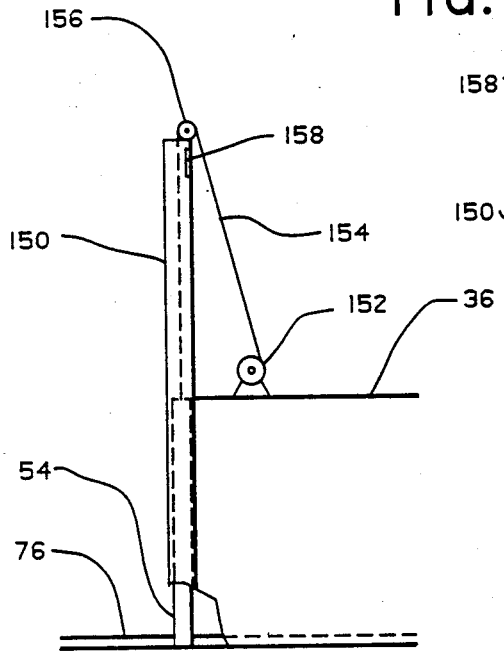
FIGS. 11 and 12 illustrate tunnel door sliding mechanisms.
Figure 12:
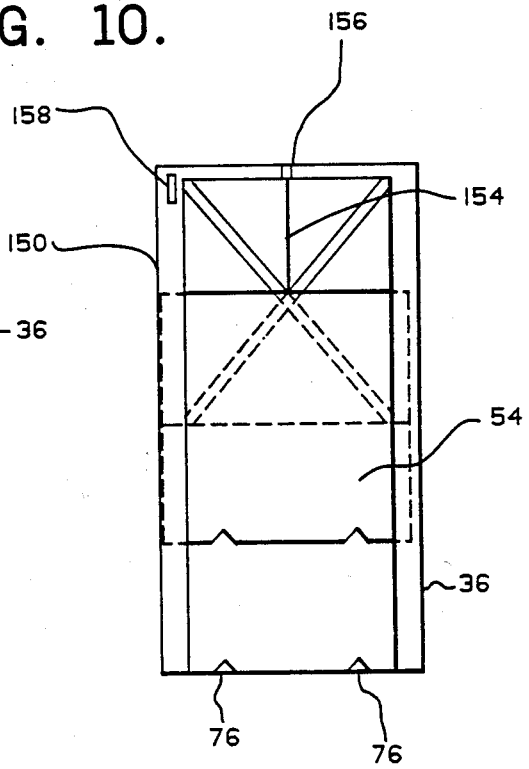

The tunnel doors 54 and 56 are sliding doors which slide within a frame 150 which extends above the tunnel 36, as illustrated in FIGS. 11 and 12. Plate steel ¼ inch thick with angle iron reinforcements will provide a suitable door. The door is lifted by a reversible motor 152 of at least ¼ horsepower and a cable 154 that runs over a pulley 156. A limit switch 158 ensures that the door 54 is not raised past a point where it will be damaged.

Figure 13:
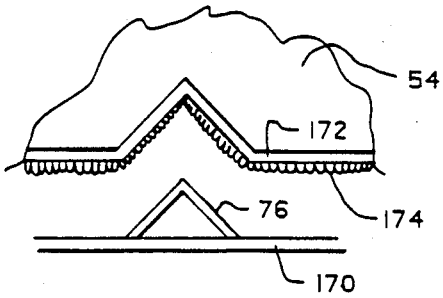
FIGS. 13 and 14 are views of a tunnel door 54 bottom seal.
Figure 14:
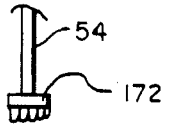
Figure 15:
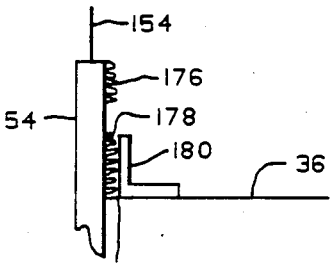
FIG. 15 is a side view of a tunnel door 54 top seal.
Figure 16:
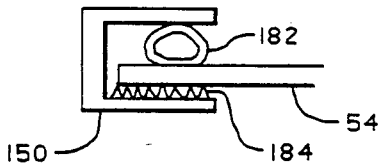
FIG. 16 is a top view of a tunnel door side seal.

A dust seal for the bottom of each door, for example, the door 54, fits over the tracks 76, against the tunnel bottom 170 and is constructed of a steel pad 172 and a fiber frax gasket 174, as illustrated in FIGS. 13 and 14. The top of each door is sealed with another pair of fiber frax gaskets 176 and 178, as illustrated in FIG. 15. One of the gaskets 176 is mounted on the door and the other gasket 178 is mounted on a 1 inch angle iron 180 welded to the top of the tunnel 36. The door, because of the negative pressure in the tunnel 36 created by combustor 12, will be pulled toward the tunnel 36, helping to create a dust-tight seal. To ensure that a very tight seal is created, an inflatable door gasket 182, located along the sides of frame 150, pushes the door against a fiber frax gasket 184, as illustrated in FIG. 16. An appropriate inflatable gasket can be obtained from Sealmaster Corp. of Kent, Ohio.

Figure 17:
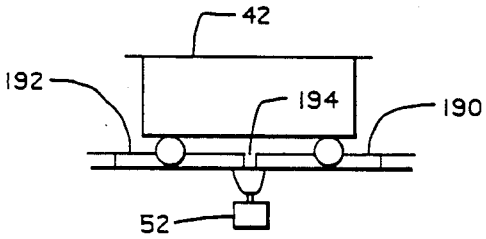
FIG. 17 illustrates the arrangement for weighing a car 42.
Figure 18:
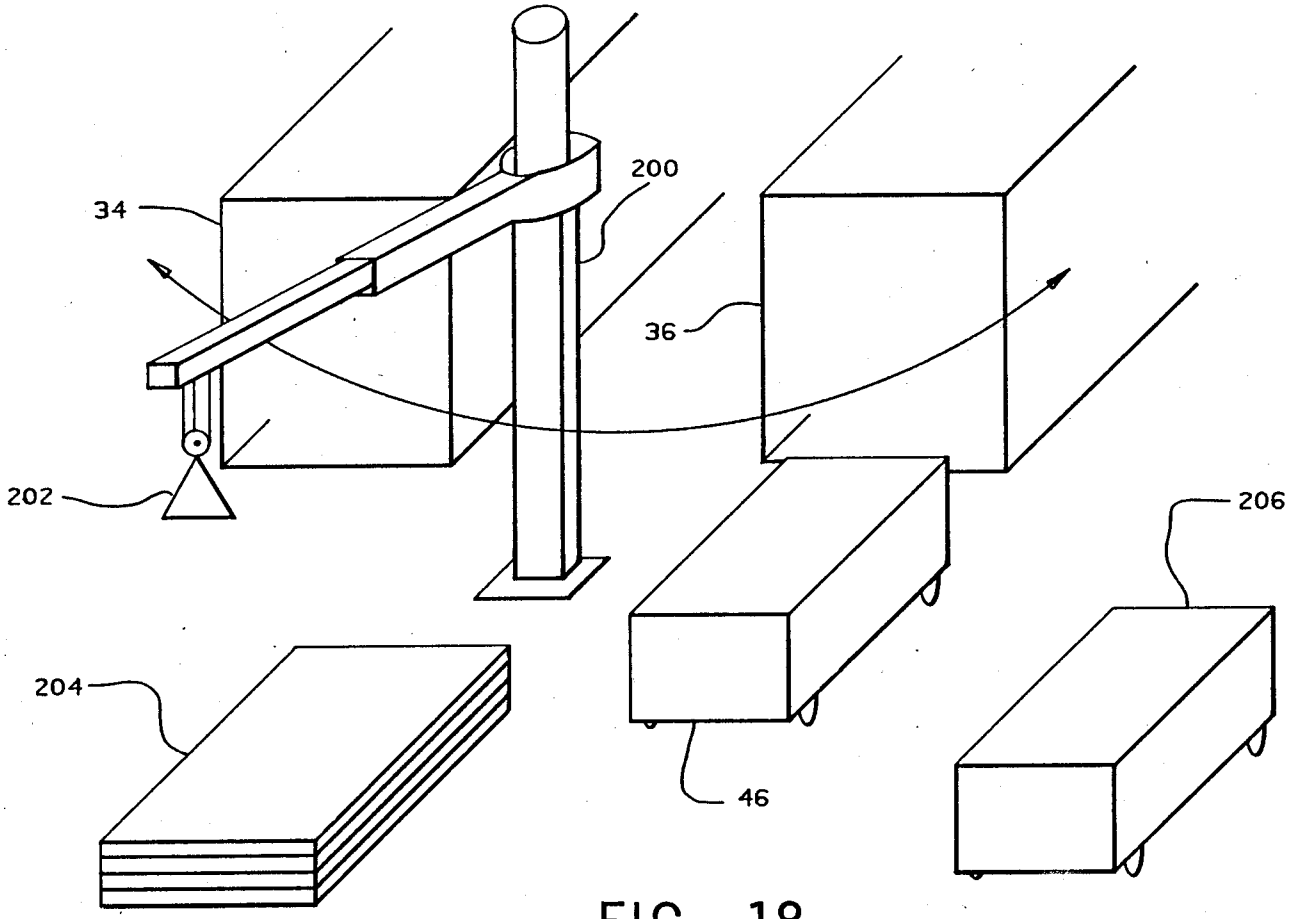
FIG. 18 shows a crane 200 for moving car lids 204.
Figure 19:
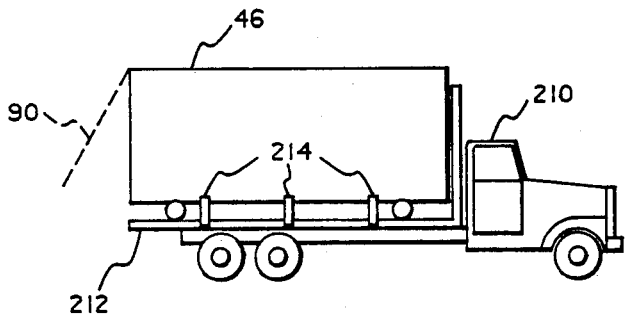
FIG. 19 illustrates a truck 21 with a tilting bed 212 for emptying a car 46.

The weighing system for weighing the ash in car 42 to determine when a new car should be moved under chute 30 is illustrated in FIG. 17. The load cell 52 includes a substantially non-compressible load measuring device such as a piezoelectric sensor load cell, which supports the ends of two rail segments 190 and 192. The ends of the rail segments 190 and 192 supported by the load cells include a very small gap 194 between the rails which allows the rails to freely move. The other ends of the rail segments are substantially fixed in place. Only one of the rails in the weighing section under the car 42 includes a load cell, the other rail being a solid rail.

When a car 46 emerges from a tunnel 36 a telescoping gantry crane 200 that has an electromagnetic lifting device 202 obtains a lid 50 from a stack 204 and moves it onto the exiting car 46. When a car 206 returns, the telescoping gantry crane 200 lifts the lid 50 off of the car 206 after the C-clamps 140 holding the lid 50 on the car 206 have been removed.

The front wheels of each car are pivoting wheels to allow the car to be turned as it is moved about on a concrete pad surrounding the tunnels 34 and 36 by a tow motor type vehicle. The tow motor will also align the car 46 with the rails 76 of the tunnels 34 and 36. A car 46 which is full, is loaded onto a truck 210 by the pushing action of the tow motor. The truck 210 can be based on a highway coal carrying dump truck which includes a tilting hydraulically operated bed 212. The car 46 is strapped to the truck bed using dump truck latches or truck chain tighteners 214. When the truck 210 arrives at the landfill, the latches 96 are released from the rear door 90 and the bed 212 is tilted, dumping the contents of the car 46.

Figure 20:
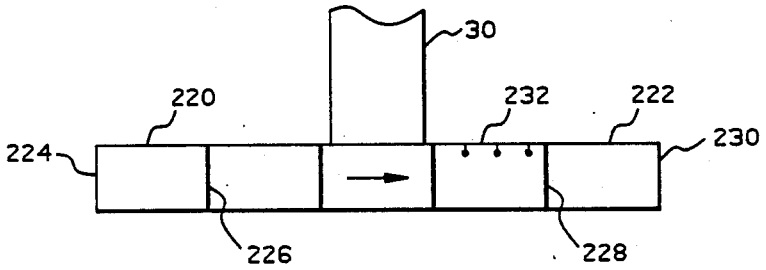
FIG. 20 is a side view of an alternate tunnel embodiment.

If there is insufficient room under the combustor 12 to provide two tunnels 34 and 36, as illustrated in FIG. 2, a single tunnel 218 can be provided if isolation chambers 220 and 222 are provided, as illustrated in FIG. 20. The entrance isolation chamber includes an external door 224 and an internal door 226 which cannot be opened simultaneously. The outgoing isolation chamber 222 also includes doors 228 and 230 that cannot be opened simultaneously. When a car is moved into the tunnel 218, first the isolation door 224 is opened. While the car is in chamber 220 a drive mechanism such as a chain pull is connected to the car. Next, the door 224 is closed. Then door 226 is opened and the car is pulled into the tunnel by the drive mechanism forcing a car into burn-out and cooling chamber 232 through the open door 228 into the outgoing chamber 222. Once a car is in isolation chamber 222 it can be removed by a tow motor after door 228 is closed and door 230 is opened.

The many features and advantages of the invention are apparent from the detailed specification and thus, it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, and accordingly, all suitable modifications and equivalents may be resorted to, falling within the scope of the invention.

I claim:

1. An ash handling system, comprising:

an ash gate controlling ash movement direction;

first and second ash chutes coupled to said gate, one of said chutes at a time receiving ash from said gate;

first and second vehicle tunnels coupled to said first and second ash chutes respectively and adapted to receive and discharge vehicles, each tunnel including an entrance chamber with a sealable entrance door, an ash collection chamber with a chute seal, a burn-out chamber with a sealable exit door having an air inlet, and a track traveling therethrough;

an ash car having wheels rolling on the track and rollable on a flat surface, mating with the chute seal when in the ash collection chamber, having an air infusion pipe mating with the air inlet when in the burn-out chamber, having a lid clamped to said car after exiting the burn-out chamber and having a sealable dump door;

means for taking the lid off and putting the lid on said car; and means for carrying said car to an ash disposal site and dumping the ash through the dump door.

2. An ash handling system, comprising:

a sealable vehicle chamber openable at two ends and including a burn-out chamber with an air opening;

an ash chute entering said vehicle chamber and having a negative air pressure; and an ash car positionable under the ash chute in said vehicle chamber, receiving ash from said chute and having an air entrance tube abutting the air opening when in said burnout chamber, no ash being deposited in said car when in said burn-out chamber and the tube having air slots allowing air to move through the ash into said chute while said car is in said burn-out chamber.

3. A system as recited in claim 9, wherein said car includes a lid attached to said car, when said car is removed from said chamber, preventing ash form escaping from said car.

4. A system as recited in claim 3, wherein said car includes a top edge flange and said lid includes:

a seal gasket interfacing with said top edge flange; and a clamp for clamping said lid to said car top edge flange.

5. A system as recited in claim 3, wherein sad car further includes a sealable swinging dump door on one end through which the ash is dumped.

6. A system as recited in claim 5, wherein said dump door includes:

a seal gasket between said dump door and said car; and a clamp for clamping said dump door to said car and preventing swinging.

7. A system as recited in claim 1, wherein said sealed chamber comprises first and second tunnels through which said car passes and said chute includes first and second chutes entering said first and second tunnels, and an ash gate for directing ash to one of said first and second chutes.

8. A system as recited in claim 7, wherein said first and second tunnels include:

sealable sliding doors at each end;

a dust seal between said car and the corresponding chute.

9. A system as recited in claim 8, wherein said first and second tunnels include means for determining when said car is full of ash.

10. A system as recited in claim 2, further comprising a truck including a tiltable bed and carrying said car to an ash deposit location where the bed is tilted to dump the ash out of said car.

11. A system as recited in claim 3, further comprising means for taking the lid off of and putting the lid on said car.

12. A system as recited in claim 1, wherein said chamber includes a track and said car includes wheels rollable on said track and a flat surface.

* * * * *